US005259080A

United States Patent [19]

Blaha

[11] Patent Number: 5,259,080

[45] Date of Patent: * Nov. 9, 1993

[54] DAMPED AIR DISPLACEMENT SUPPORT SYSTEM

[75] Inventor: Joseph W. Blaha, Pattersonville, N.Y.

[73] Assignee: Lumex, Inc., Bay Shore, N.Y.

[ * ] Notice: The portion of the term of this patent subsequent to Aug. 3, 2010 has been disclaimed.

[21] Appl. No.: 626,485

[22] Filed: Dec. 12, 1990

[51] Int. Cl.[5] ..... A47C 27/14

[52] U.S. Cl. ..... 5/481; 5/450

[58] Field of Search ..... 5/481, 450, 480, 464, 5/468

[56] References Cited

U.S. PATENT DOCUMENTS

| | | | |
|---|---|---|---|
| 3,161,436 | 12/1964 | Hood | 5/481 |
| 3,246,443 | 4/1966 | Slemmons | 5/481 |
| 3,335,435 | 8/1967 | Marsh | 5/481 |
| 3,564,628 | 2/1971 | Oxford | 5/450 |
| 3,730,588 | 5/1973 | Braun | 5/450 |
| 3,864,766 | 2/1975 | Prete | 5/450 |
| 4,261,776 | 4/1981 | Lea | 5/450 |
| 4,571,763 | 2/1986 | Suzuyama | 5/481 |
| 4,928,337 | 5/1990 | Chauncey | 5/481 |

FOREIGN PATENT DOCUMENTS

| | | | |
|---|---|---|---|
| 555821 | 3/1957 | Belgium | 5/464 |

*Primary Examiner*—Peter M. Cuomo
*Assistant Examiner*—Flemming Saether
*Attorney, Agent, or Firm*—Heslin & Rothenberg

[57] ABSTRACT

A damped gas displacement support system which includes an envelope of flexible, gas impervious material and a core of partially compressed, flexible cellular material occupying the space within the envelope, the cellular material compression being sufficient to establish a partial vacuum therein. When force is applied to the cell the partially compressed and partially evacuated core instantly seeks equilibrium about that area of the envelope receiving the applied force. Various system embodiments are described and illustrated, along with a preferred method for manufacturing the support cell.

20 Claims, 7 Drawing Sheets

DAMPED AIR DISPLACEMENT SUPPORT SYSTEM

BACKGROUND OF THE INVENTION

1. Technical Field

This invention relates to support systems, and more particularly, to systems such as mattresses, cushions, upholstery padding and the like having a resilient cellular material therein and to methods for manufacturing the same.

2. Description of the Prior Art

Many support systems exist within the art which attempt to provide pressure relief for an individual. A trade-off typically occurs in all such systems between comfort, stability and weight in order to achieve a marketable device. For example, support systems which contain liquid, such as waterbeds and water filled cushions, have various support benefits which are well known. On the other hand, such systems also exhibit many disadvantages. In particular, conventional waterbeds and water filled cushions produce a kind of wave action or rolling motion when in use due the tendency of water or other liquid inside the system to rush rapidly from one part thereof to another when an individual places his weight thereon, thereby forcing the liquid to flow to another part of the system. Moreover, since the envelope containing the liquid in such a system is typically elastically yieldable, a reaction to an initial liquid surge occurs. This reaction often results in a succession of countersurges within the envelope until the system reaches equilibrium. The described undamped surging and countersurging of the liquid in such systems is annoying to most users thereof. In order to obviate the above mentioned disadvantages, many waterbed manufacturers do not employ liquid displacement in that portion of the system which is intended to support the head and shoulders of the user. Instead, they employ a section of mattressing constructed in the conventional manner utilizing coil springs or other equivalent non-liquid structures. Obviously, this introduces an element of complexity to the manufacturing process and, as well, increased costs. Other manufacturers have attempted to dampen waterbed wave motion in various ways. In U.S. Pat. No. 3,585,356 the use of solid particles, such as Styrofoam ®, are disposed in liquid for this purpose. U.S. Pat. No. 3,736,604 uses flap means, as illustrated in FIG. 11 therein.

Saloff et al. describe in U.S. Pat. Nos. 4,942,634 and 4,370,768 (entitled "Damped Fluid Displacement Support System and Method for Making the Same" and "Damped Fluid Displacement Support System," respectively, both of which are assigned to the same assignee as the present invention) substantially completely stable damped liquid displacement support systems. In these systems, a core of resilient liquid absorbent material is disposed within a liquid impervious sealed envelope, the core being saturated with a liquid. When force is applied to the system the liquid within the cell migrates from one portion thereof to another before coming to equilibrium about the applied force. The foam core prevents the liquid from rushing from one region where pressure is applied to another region in the support cell. Thus, movement of the fluid within the cell is "damped" Further, the amount of water available to be displaced within the cell is less than one would find in a conventional system and, therefore, the damped liquid system weighs less than a conventional system.

Notwithstanding the commercial success of this damped system, certain drawbacks inherent in the liquid construction remain. For example, although lighter than preexisting liquid support systems, the jell or water used therein necessarily makes the weight of the system a consideration for many individuals who may wish to own such a device. Further, although better than conventional water support systems, a period of time is required before the damped liquid support system achieves equilibrium about an applied force, during which time there may be a feeling of instability in the individual using the system.

Non-liquid filled support systems, such as air filled mattress or cushion cells, are also typically unstable when pressure is applied thereto. In addition, such systems provide pressure relieving support characteristics generally inferior to those available with water filled systems.

Thus, there continues to exist a need for a new type of support system which achieves greater comfort and stability with less weight than presently available body support systems, while still providing comparable or superior pressure relieving support.

SUMMARY OF THE INVENTION

Briefly summarized, the present invention comprises in one broad aspect a support cell having an envelope of flexible material within which a core of partially compressed, flexible cellular material is located. The compression of the core cellular material is sufficient to establish a partial vacuum within the envelope such that when force is applied to the cell the core instantly seeks equilibrium about that area of the envelope receiving the applied force.

In a further embodiment, the invention comprises a damped gas displacement support system which includes an envelope of flexible gas impervious material having two substantially parallel panels of substantially the same size. Each panel has a boarder surface, and the boarder surfaces of the panels are sealed together in a gas impervious seam. One of the panels serves as a body supporting surface. The envelope has a core of partially compressed, resilient, gas-absorbent cellular material occupying the space defined thereby. The core is maintained in its partially compressed state by the panels of the envelope. Lastly, a gas is constrained within and partially fills the cellular material such that the envelope immediately seeks equilibrium about that portion of the individual's body contacting the body supporting surface.

In an enhanced version, the system embodiment further includes a relatively thick resilient material surrounding the envelope, which together define either a mattress or a cushion. Further, and depending upon the implementation, a wall may be used to divide the interior of the envelope into multiple compartments, each compartment being occupied by the partially compressed, flexible cellular material with the gas partially constrained therein. Again, depending upon the desired response characteristics, one or more openings in the divider wall may be provided for communication of constrained gas or air therebetween. Other specific enhancements are described and claimed herein.

Lastly, a method for making the novel damped air displacement support cell of the present invention is set forth. The method includes the steps of: forming a stack by placing a core of resilient air-absorbent material between two panels of air impervious material, the panels being sized to form an envelope once sealed together, and the resilient air-absorbent material being sized to overfill the envelope once the panels are sealed together; partially compressing the stack to force a portion of the air constrained therein from the resilient air-absorbent material; and sealing the panels together in an air impervious seam to form the envelope while maintaining the stack in its partially compressed condition.

The cell system of the present invention described herein may be used to provide greater comfort and stability, with less package weight than preexisting body supporting techniques. The cell/system described herein has the unique feature of instantly contouring to a body to provide pressure relief, but in such a way that stability is never jeopardized. This is accomplished by applicant's unique foam overfilling and vacuum creation combination. The cell/system is far superior to preexisting systems which typically, for example, suffer from wave effect and/or promote an unstable feeling when pressure is applied thereto.

BRIEF DESCRIPTION OF THE DRAWINGS

These and other objects, advantages and features of the present invention will be more fully understood from the following detailed description of certain embodiments thereof when considered in conjunction with the accompanying drawings in which.

DETAILED DESCRIPTION OF THE INVENTION

Figure 1:
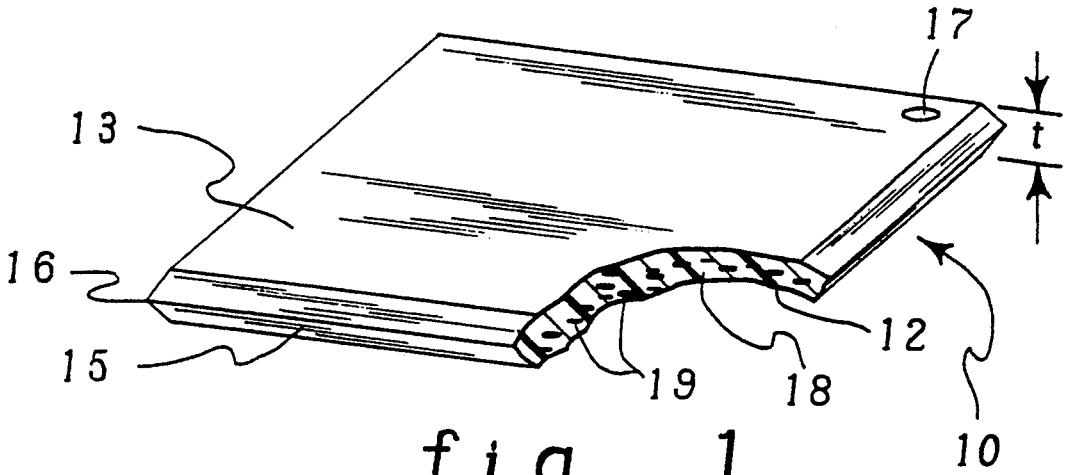
FIG. 1 is a partially cutaway perspective view of one embodiment of a damped air displacement support cell pursuant to the present invention.

One basic embodiment of a damped air displacement support cell 10 pursuant to the present invention is shown in FIG. 1. Cell 10 includes a flexible envelope 12 formed by heat sealing together upper and lower panels 13 & 15, respectively, along a circumferential seam 16. Envelope 12 comprises a gas impervious material such as a high quality "pool grade vinyl". The vinyl has a thickness of about 0.020 inch, and a cold crack resistance of at least about minus 20° Fahrenheit. Further, the vinyl has properties that permit panels 13 & 15 to be readily fused together by standard dielectric heating techniques.

Figure 10A:
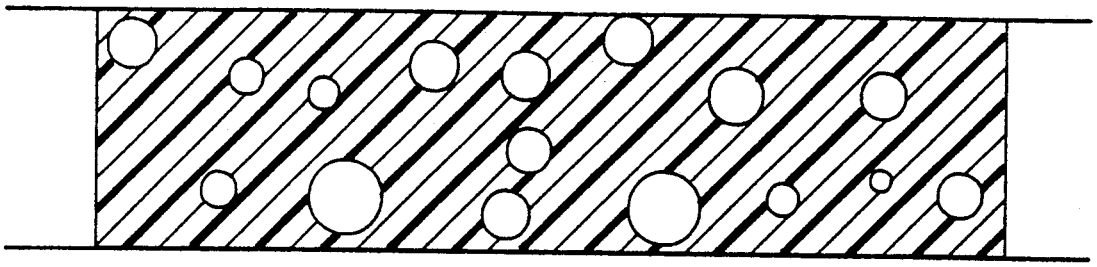
FIGS. 10*a*–10*c* illustrate one method for manufacturing the damped air displacement support cell of the present invention.

A valve 17 is mounted in panel 13 of envelope 12 to permit communication between the interior of the envelope and its ambience in order to evacuate gases therein pursuant to one embodiment of the present invention. The valve is of the positive closing type and in this respect it has been found that Type 1020 AF manufactured by Halkey-Roberts is suitable for this purpose. In an alternate embodiment, (manufactured as described below with reference to FIG. 10*a*–10*c*) no value is included within the envelope, wherein fusion of the upper and lower panels along their circumferential seam produces a permanently sealed, gas impervious envelope.

A core of resilient, partially compressed, gas-absorbent cellular material 18 (e.g., polyurethane foam) occupies the space within envelope 12. Cellular material 18 is maintained in its partially compressed state by panels 13 & 15 of envelope 12. In effect, "extra" cellular material is positioned within the envelope. Material 18, which is preferably compressed in the range of 5 percent to 50 percent its normal dimensions, has a gas (or gaseous mixture such as air) constrained within a portion of its cellular structure, such as compressed cells 19. As described further below, certain cells of the cellular structure are also evacuated.

The degree of material 18 compression depends upon desired support/response characteristics of the cell, along with characteristics of the particular cellular material used. For example, those skilled in the art will recognize that low density polyurethane foam, such as 1.2 lb. foam, requires greater compression than a medium density foam, e.g., 1.6 lb. foam, to produce the same support and response characteristics. Similarly, a medium density foam requires a greater percent compression than high density foam to produce comparable response characteristics. By way of example, if the desired thickness "t" of envelope 10 is approximately 1 inch, and a medium density cellular material, such as 1.6 lb. polyurethane foam, is used, then material 18 may have an uncompressed thickness of 1.25 inches, meaning the material is compressed roughly 25 percent when sealed within the envelope. The extent of compression may vary between implementations, but the concept of maintaining cellular material in a compressed state in the resultant structure is a significant feature of the present invention.

As noted, a gas or gas mixture such as air, also occupies part of the space within envelope 12. For ease of cell manufacture air is presently preferred as the gas medium to be constrained within the open cellular structure of partially compressed material 18. Note that partial compression of material 18 typically produces a partial evacuation of air from certain cells of the open cellular structure. Thus, when force is applied to the support cell changing the envelope's configuration, these evacuated cells have the capacity to expand and accept air from other parts of the envelope. This transfer of air within the envelope occurs substantially instantaneously, at least in comparison with conventional liquid support systems. Further, the extra foam material within the envelope results in a much softer support system than preexisting support systems.

During one preferred manufacturing method (described below) for cell 10, simultaneous with compression of cellular material 18, a certain percentage of the air constrained within the cellular material is allowed to escape or evacuate therefrom. Thus, once sealed the core of envelope 12 is partially evacuated such that when force is applied thereto air within the cellular structure propagates through material 18 and the material readily contours to obtain an equilibrium configuration about the applied force. If desired, envelope 12 can be further evacuated, for example, through valve 17, to create a greater vacuum within its core and therefore different response characteristics. Again depending upon the density of the cellular material selected and the desired support/response characteristics of the cell, the core of envelope 12 is typically evacuated in the range of 5 percent to 50 percent.

The combination of partial compression of material and partial evacuation of gas from the cellular material within envelope 12 provides cell 10 with significant performance advantages over previously known products. For example, for such a relatively simple construction, immediate response and impressive stability exists with the support cell of FIG. 1 when pressure is applied thereto, that is, when an individual's body contacts a supporting surface (one of the envelope defining panels). When pressure is applied to one of the surfaces of the cell, the cell adjust at the point of contact substantially instantly since the interior core of the cell is under vacuum. Further performance advantage is provided by the compressed foam material within cell 10 which also expands substantially instantaneously when given the opportunity, i.e., to reconfigure the cell about the applied force.

Figure 3:
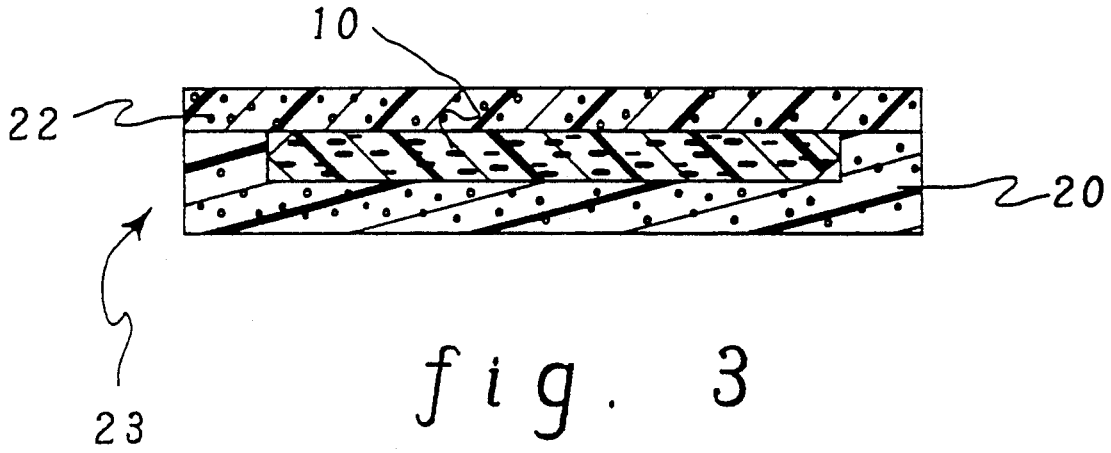
FIG. 3 is an assembled, cross-sectional view of the cushion assembly of FIG. 2 taken along lines 3—3.
Figure 2:
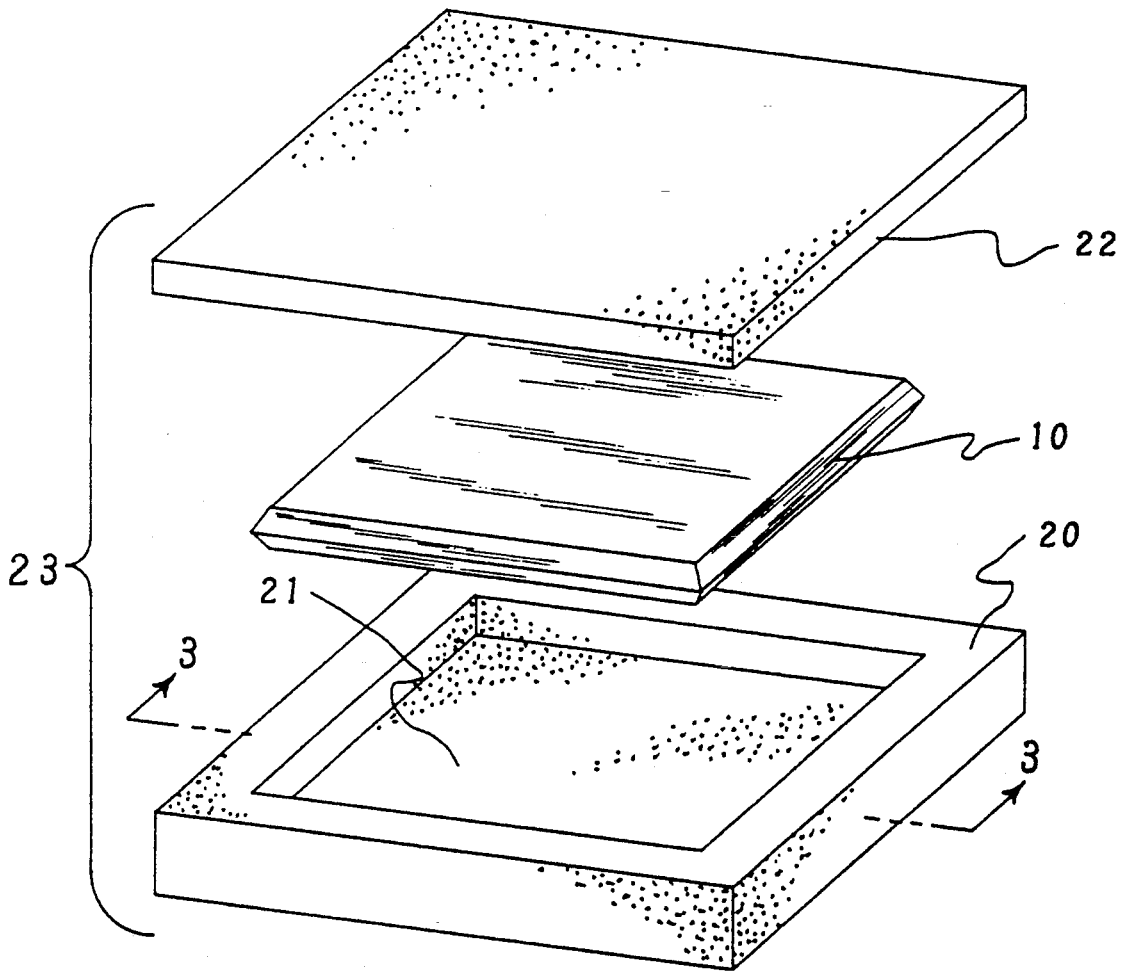
FIG. 2 is an exploded perspective view of one embodiment of a cushion assembly pursuant to the present invention which incorporates the damped air displacement support cell of FIG. 1.

One use for cell 10 is depicted in the cushion assembly 23 of FIGS. 2 & 3. In this embodiment, cell 10 is accommodated within an opening 21 defined in a base frame 20, and is retained therein by a top structure 22, which is preferably glued to base frame 20. Base 20 and top 22 are constructed of a resilient material, such as urethane foam of appropriate density. By way of example the base and top of cushion 23 may comprise 2.2 lb. and 1.9 lb. foam, respectively. This cushion structure is particularly useful as a base or back cushion for a conventional chair or for the base or back support surface of a wheelchair.

Figure 4:
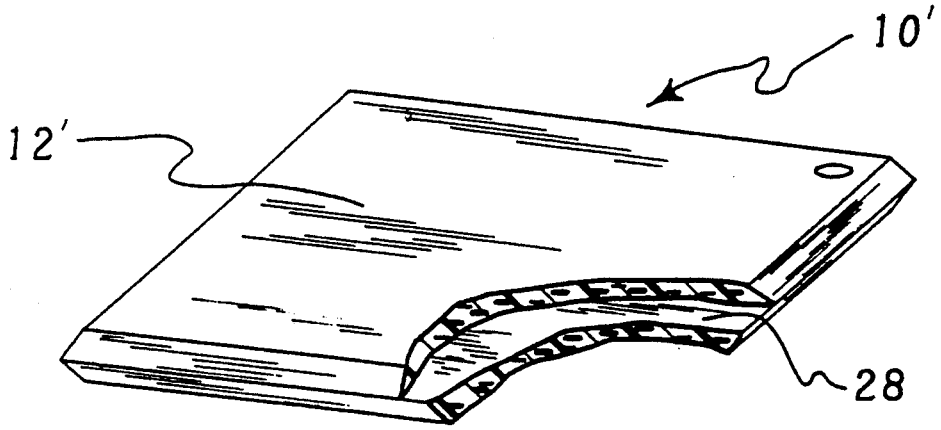
FIG. 4 is a partially cutaway perspective view of an alternate embodiment of a damped air displacement support cell pursuant to the present invention.

Alternate embodiments of the damped air displacement cell of the present invention may also be constructed. For example, in the cell 10' embodiment depicted in FIG. 4, a core divider 28 positioned substantially parallel to the upper and lower panels of envelope 12' is provided. In this embodiment, divider 28 functions to further throttle the flow of gas and the reconfiguration of material within the cell, i.e., in response to an applied force, by dividing the core into multiple compartments. If desired, one or more openings, for example peripherally located openings (not shown), may be provided in divider 28 to allow the communication of gas constrained within the different cell compartments to communicate therebetween. Further and more intricate modifications to the basic cell structure of FIG. 1 are described below with reference to accompanying FIGS. 5-9.

Figure 5:
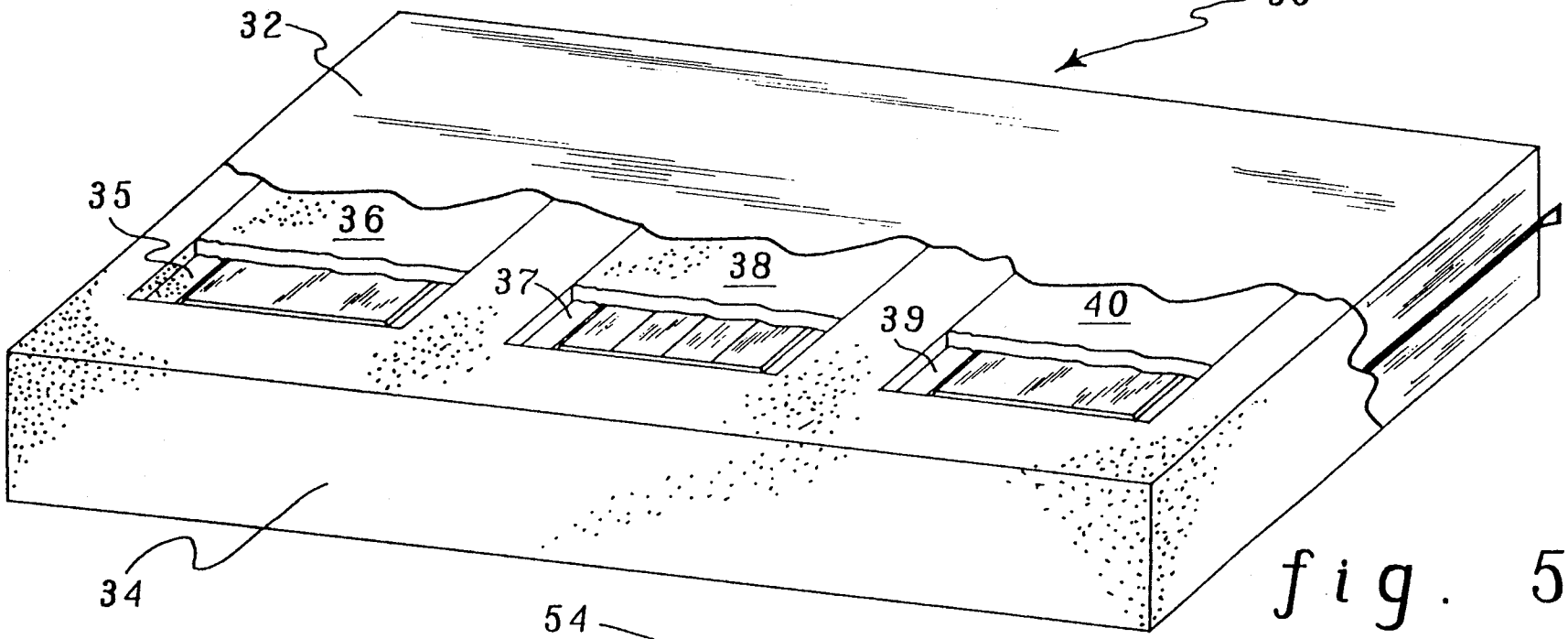
FIG. 5 is a partially cutaway perspective view of one embodiment of a mattress assembly pursuant to the present invention.

FIG. 5 depicts one configuration of the present invention useful as a mattress 30. Mattress 30 has a casing 32 manufactured of any suitable material generally used for mattresses. The material must be soft and have enough stretchability so as not to restrict the action of the invention as described herein. Preferably, a zipper 31 is provided to facilitate removal of casing 32 from mattress 30 for cleaning or replacement.

In the embodiment shown, a flexible foam frame structure 34 (e.g., 1.9-2.2 lb. polyurethane foam) defines three similar sized openings 35, 37 & 39 which accommodate cushions assemblies 36, 38 & 40, respectively. As with the cushion embodiment of FIGS. 2 & 3, each cushion assembly 36, 38 & 40 includes a foam frame having a base and a top, along with an inner cell manufactured pursuant to the present invention. Depending on the mattress size desired, e.g., twin vs. king size, mattress 30, cover 32 and frame 34 may be configured to accommodate one, or two or more side by side positioned cushion assemblies 36, 38 & 40. Assemblies 36, 38 & 40 are each dimensioned to fit within the corresponding openings 35, 37 & 39, respectively, provided within frame 34.

In one implementation, cushion assemblies 36 & 40 (referred to herein as "end cushions") are identically constructed. One embodiment for the end cushion assembly is depicted in FIG. 6, while a preferred embodiment for cushion assembly 38 (referred to herein as a "center cushion") is depicted in FIGS. 7-9.

Figure 6:
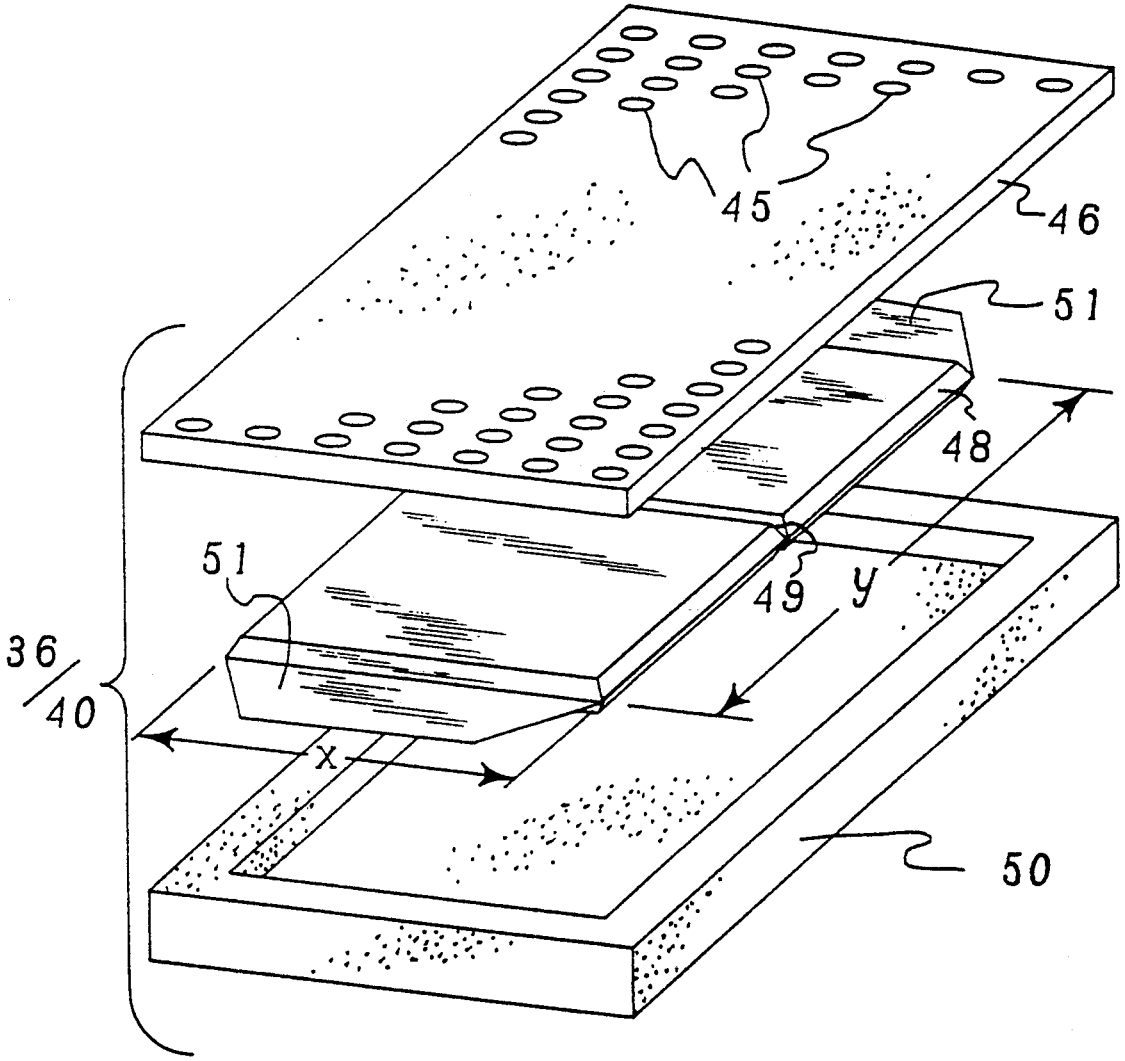
FIG. 6 is an exploded perspective view of an end cushion assembly used in a mattress assembly of the subject invention.

Referring first to FIG. 6, the end cushion assembly 36/40 is shown in exploded view. The end cushion includes a top panel 46, a damped air displacement support cell 48 and a bottom supporting frame 50. Top panel 46 and bottom frame 50 are each manufactured of a flexible foam material, such as that described above with reference to FIGS. 2 & 3. A plurality of holes 45 are provided in top panel 46 to facilitate the dispersement of heat generated within the assembly.

Cell 48 is essentially constructed as described above with reference to cell 10 of FIG. 1. However as shown, cell 48 also includes a centrally located transverse seam 49, which divides the cell into two separate compartments, and oppositely extending tabs 51 from the main body of cell 48. Seam 49 is formed, for example, by heat sealing the upper and lower panels of the cell's envelope together along a transverse line. Alternatively, a longitudinal seam (not shown) in cell 48 could be substituted for seam 49, as could various other combinations of compartment defining seams. Multiple cell compartments are desirable when the size of the cell becomes relatively large, for example, twenty inches or more in width "x" and/or length "y". This prevents the undue collection of gas (air) and/or material (foam) in any one portion of the cell when a force is applied to another part thereof.

Figure 9:
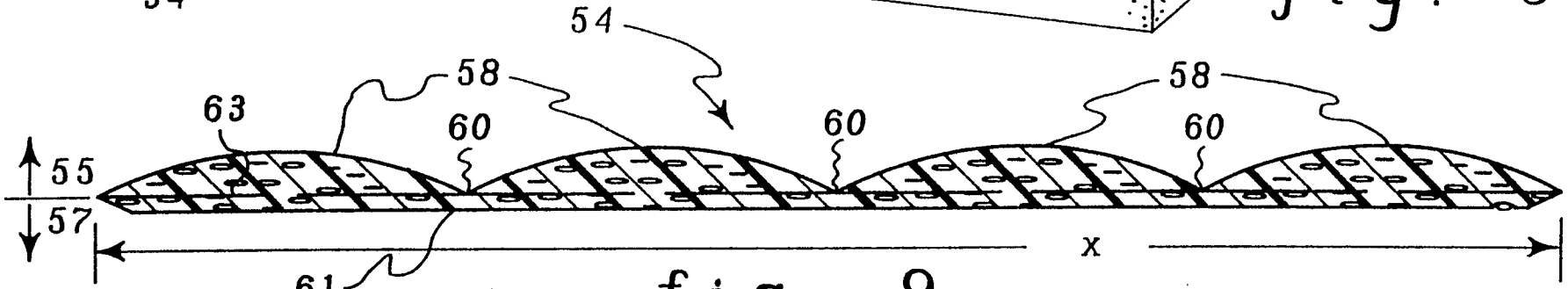
FIG. 9 is a cross-sectional view of the damped air displacement support cell of FIG. 8 taken along lines 9—9.
Figure 7:
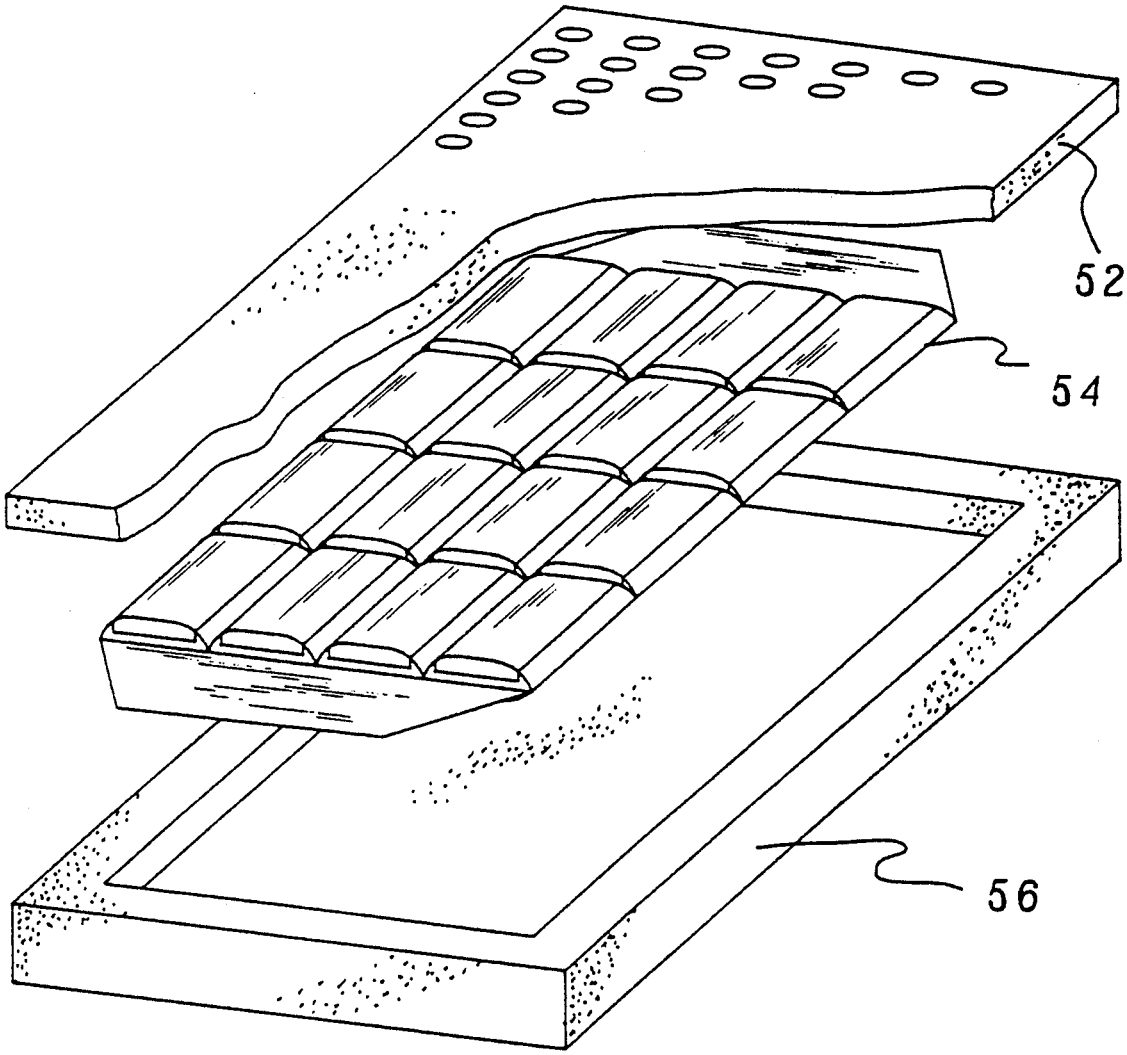
FIG. 7 is a partially cutaway exploded perspective view of a center cushion assembly used in a mattress assembly of the subject invention.
Figure 8:
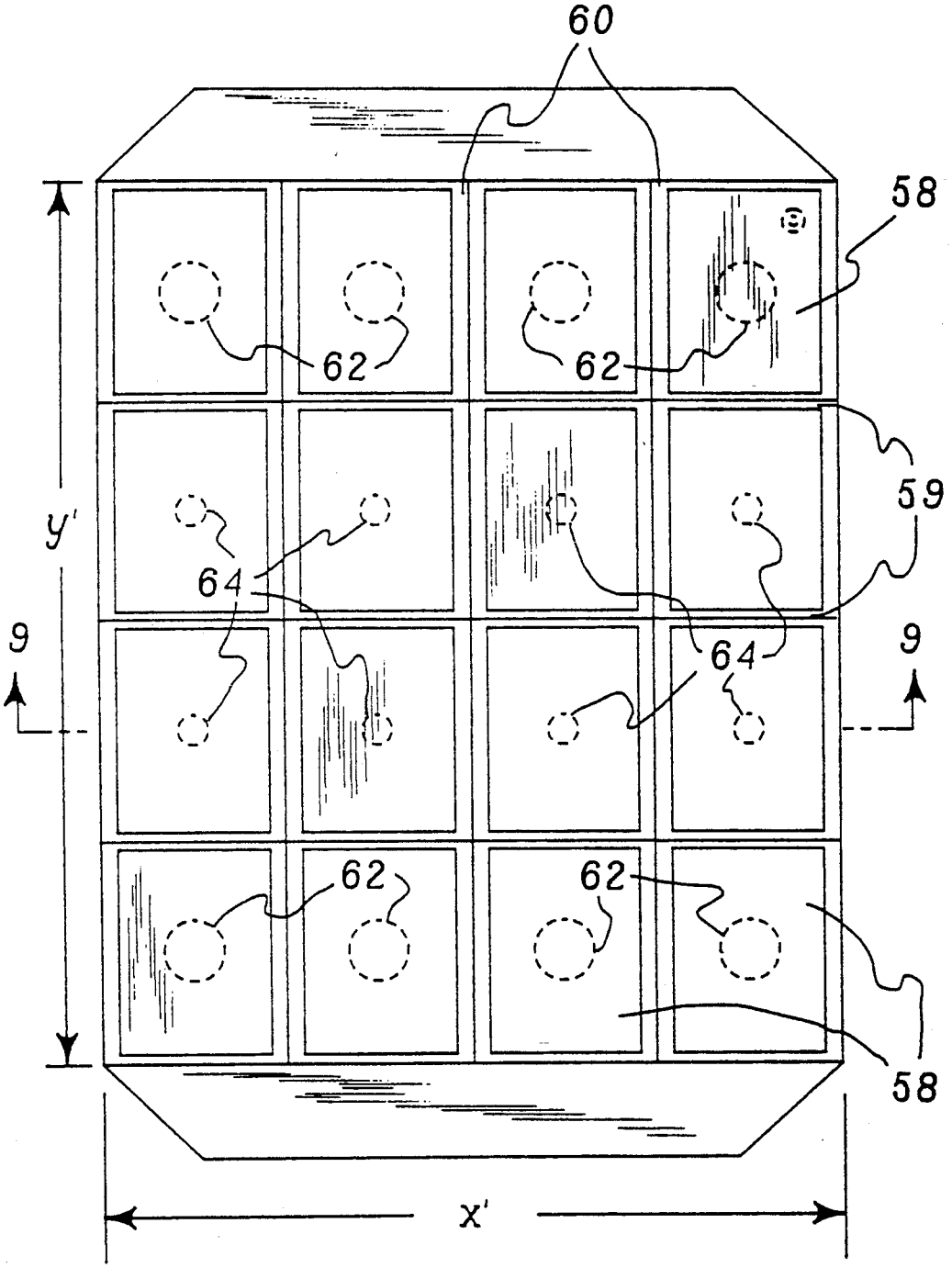
FIG. 8 is a top plan view of the damped air displacement support cell of the center cushion assembly of FIG. 7.

As noted, one embodiment of center cushion assembly 38 is shown in FIGS. 7-9. Assembly 38 includes a top panel 52, a center cell 54 and a base frame 56. The assembly is sized to fit within the opening 37 in the mattress frame structure 34 (see FIG. 5). Top 52 and base 56 are, again, each manufactured of a flexible foam material such as that described above with respect to the end cushion assembly. The significant difference between assembly 38 and end cushion assemblies 36 & 40 is in the design of the inner cell 54 in comparison with cell 48 (FIG. 6).

As best shown in FIG. 9, cell 54 is divided into an upper section 55 and a lower section 57. Section 55 is further divided into a plurality of compartments 58 by transverse seams 59 (see FIG. 8) and longitudinal seams 60. In one preferred embodiment, lower section 57 comprises one large compartment of width "x'" and length "y'" (FIG. 8), and having a relatively high density cellular material therein in a compressed state. As a specific example, for a twin size mattress, dimensions x' and y' may be 23 and 29 inches, respectively; and the cellular material positioned in lower section 57 may comprise 2.2 lb. foam. The high density foam is maintained compressed in cell 54 by lower panel 61 and an interior divider 63 (FIG. 9) between which the foam is positioned. The multiple compartments of upper section 55 each include a medium density cellular material, which again pursuant to the invention is in a partially compressed state and partially evacuated of air or other gas constrained therein. Preferably, the various compartments of upper section 55 and the compartment of lower section 57 communicate with one another through one or more ports. In the embodiment illustrated, a centrally located port is provided in the interior divider for each upper section compartment 58. The lengthwise outer compartments (see FIG. 8) each include a larger stabilization port 62 while the longitudinally inner compartments each have a smaller communication port 64. Ports 62 and 64 are shown in phantom in FIG. 8. By providing larger openings at the outer compartments, a person lying near the middle of mattress 30 (FIG. 5) tends to be cradled as a result of air/-foam movement within cell 54 of cushion assembly 38 and cells 48 of cushion assemblies 36 & 40.

Figure 10B:
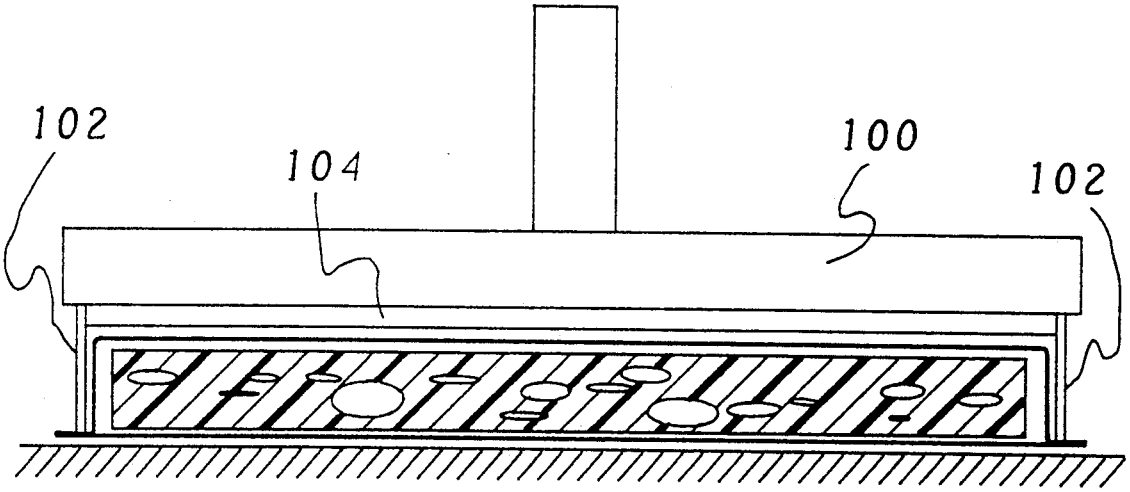
Figure 10C:
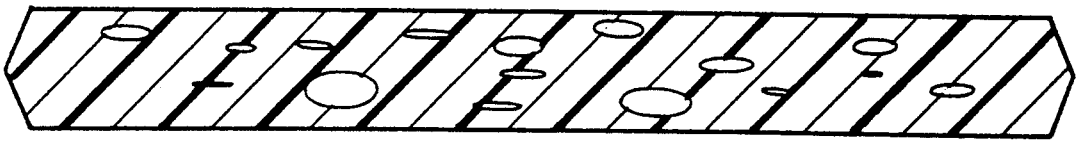

In accordance with the invention there is also provided an efficient method for making a damped air displacement support system which includes: forming a stack by placing a core of resilient air-absorbent material between two panels of air impervious material, the two panels being sized to form an envelope once sealed, and the resilient air-absorbent material being sized for partial compression once the panels are sealed to form the envelope (see FIG. 10*a*); partially compressing the stack so as to force a portion of the gas constrained within the resilient air-absorbent material therefrom and to allow the circumferential edges of the upper and lower panels to come in contact (FIG. 10*b*); and sealing the upper and lower panels together in an air impervious seam while maintaining the stack in its partially compressed position such that an envelope is formed having a core of compressed cellular material which is partially evacuated (FIG. 10*c*). If desired, the method may further comprise the step of evacuating additional air from the envelope through a valve positioned in one of the panels. In the embodiment depicted, however, a valve is rendered unnecessary by including in the heat sealing process a buffer 104 positioned within the depending die 102 against the flat surface of the heat sealer 100 as shown in FIG. 10*b*. Buffer 104 comprises any spacer appropriately sized to compress the foam cell to a desired, evacuated thickness during the manufacturing process.

To summarize, a novel support cell/system, along with a method of manufacturing same, are described herein. Applicant's support cell/system allows greater comfort and stability, with less weight than preexisting body supporting techniques, and the has the unique feature of instantly contouring to a body to provide optimum pressure relief, but in such a way that stability is never jeopardized. This is accomplished by the unique combination of envelope overfilling and vacuum creation therein. The damped air displacement support cell/system is far superior to preexisting systems which typically suffer from wave effect and/or promote an unstable feeling when pressure is applied thereto.

Although certain preferred embodiments have been depicted and described in detail herein, it will be apparent to those skilled in the relevant art that various modifications, additions, substitutions and the like can be made without departing from the spirit of the invention, and these are therefor considered to be within the scope of the invention as defined by the appended claims.

What is claimed is:

1. A damped gas displacement support system comprising:

an envelope of flexible gas impervious material, said envelope having two substantially parallel panels of substantially the same size, each panel having a border surface, said border surfaces of said panels being sealed together in a gas impervious seam, one of said panels serving as a body supporting surface;

a core of partially compressed resilient gas-absorbent cellular material occupying the space within said envelope, said core being maintained partially compressed by the panels of said envelope; and a gas constrained within and partially filing said cellular material, whereby said envelope immediately seeks equilibrium about that portion of an individual's body contacting the body supporting surface, and wherein the interior of said envelope is divided into multiple compartments by at least one divider wall, said compartments being occupied by said partially compressed, flexible cellular material and said gas constrained therein.

2. The damped gas displacement support system of claim 1, wherein said resilient gas-absorbent cellular material comprises opened celled foam.

3. The damped gas displacement support system of claim 1, wherein said resilient gas-absorbent cellular material comprises polyurethane.

4. The damped gas displacement support system of claim 1, wherein said gas comprises air.

5. The damped gas displacement support system of claim 1, wherein said envelope of flexible gas impervious material is manufactured of vinyl.

6. The damped gas displacement support cell of claim 1, wherein said partial compression of said resilient gas-absorbent cellular material is in the range of 5 percent to 10 percent of said material's normal dimensions.

7. The damped gas displacement support system of claim 1, further comprising a relatively thick casing of resilient material surrounding the envelope.

8. The damped gas displacement support system of claim 7, wherein the casing and the envelope are adhesively attached to each other.

9. The damped gas displacement support system of claim 7, wherein the system is a mattress.

10. The damped gas displacement support system of claim 9, wherein said envelope having said core of compressed cellular material and said gas partially constrained therein comprises a support cell, and wherein said mattress system includes multiple support cells.

11. The damped gas displacement support system of claim 10, wherein said mattress system includes three cells longitudinally spaced, the end cells of said mattress system being substantially identical.

12. The damped gas displacement support system of claim 11, wherein each of said end cells is divided into multiple compartments by at least one divider wall, said compartments each being occupied by said partially compressed, flexible cellular material and said gas partially constrained therein.

13. The damped gas displacement support system of claim 7, wherein the system is a cushion.

14. The damped gas displacement support system of claim 1, further comprising a valve mounted in said envelope for communication between the interior thereof and its ambience for admitting and discharging gases.

15. The damped gas displacement support system of claim 1, wherein said compartments communicate with each other through an opening in said at least one divider wall.

16. The damped gas displacement support system of claim 1, wherein at least one of said compartments is occupied with a flexible cellular material of different density than the density of the flexible cellular material in another one of said multiple compartments.

17. A damped gas displacement support system comprising multiple support cells, each of said support cells comprising:

an envelope of flexible gas impervious material, said envelope having two substantially parallel panels of substantially the same size, each panel having a border surface, said border surfaces of said panels being sealed together in a gas impervious seam, one of said panels serving as a body supporting surface;

a core of partially compressed resilient gas-absorbent cellular material occupying the space within said envelope, said core being maintained partially compressed by the panels of said envelope;

a gas constrained within and partially filling said cellular material, whereby said envelope immediately seeks equilibrium about that portion of an individual's body contacting the body supporting surface; and a relatively thick casing of resilient material surrounding the envelope, wherein at least one of said multiple support cells is divided into multiple compartments by at least one divider wall, said compartments each being occupied by said partially compressed, flexible cellular material and said gas partially constrained therein.

18. The damped gas displacement support system of claim 17, wherein one of said multiple support cells comprises a center cell and wherein said center cell is divided into a plurality of compartments by divider walls, said plurality of compartments including a single lower section compartment and a plurality of upper section compartments.

19. The damped gas displacement support system of claim 18, wherein said center cell compartments are each occupied with a partially compressed, flexible cellular material having said gas partially constrained therein, the lower section compartment having a higher density cellular material therein than the material in said multiple upper section compartments.

20. The damped gas displacement support system of claim 19, wherein said center cell includes openings in said compartment defining divider walls so that said compartments communicate with each other to allow redistribution of said constrained gas when force is applied to the cell.

* * * * *

UNITED STATES PATENT AND TRADEMARK OFFICE

CERTIFICATE OF CORRECTION

PATENT NO. : 5,259,080
DATED : 11/09/93
INVENTOR(S) : Joseph W. Blaha

It is certified that error appears in the above-indentified patent and that said Letters Patent is hereby corrected as shown below:

In column 8, line 21, claim 1, change "filing" to --filling--.

In column 8, line 42, claim 6, change "cell" to --system--.

Signed and Sealed this

Twelfth Day of April, 1994

*Attest:*

Bruce Lehman

BRUCE LEHMAN

*Attesting Officer*

*Commissioner of Patents and Trademarks*